US005380001A

United States Patent [19]

Socci et al.

[11] Patent Number: 5,380,001

[45] Date of Patent: Jan. 10, 1995

[54] BASEBALL BATTING AID

[75] Inventors: Roger Socci, Reston, Va.; Mark A. Lacko, Garrison, N.Y.

[73] Assignee: Creative Sports Design, Inc., Reston, Va.

[21] Appl. No.: 12,261

[22] Filed: Feb. 1, 1993

[51] Int. Cl.[6] ..... A63B 69/00

[52] U.S. Cl. ..... 273/26 C; 273/DIG. 17

[58] Field of Search ..... 273/26 R, 26 C, 29 A, 273/35 R, 183.1, 187 R, 187.2, 190 R, 190 A, DIG. 17

[56] References Cited

U.S. PATENT DOCUMENTS

| | | | |
|---|---|---|---|
| 4,300,765 | 11/1981 | Stringham | 273/26 C |
| 4,502,035 | 2/1985 | Obenauf et al. | 273/187.2 X |
| 4,605,226 | 8/1986 | Morrissey | 273/26 C |
| 4,826,165 | 5/1989 | Socci | 273/26 R |
| 4,869,509 | 9/1989 | Lee | 273/187.2 X |
| 5,108,104 | 4/1992 | Johnson | 273/187.2 |
| 5,118,104 | 6/1992 | Delanzo | 273/26 C |
| 5,199,712 | 4/1993 | Hoyle, Jr. et al. | 273/187.2 |

*Primary Examiner*—William H. Grieb

*Attorney, Agent, or Firm*—Armstrong, Westerman, Hattori, McLeland & Naughton

[57] ABSTRACT

The present invention is concerned with a training device which can be worn by a user to teach the correct body position when hitting a baseball comprising: an adjustable sensing mechanism fitted on the batters helmet to sense the vertical movement of the batters's head in relation to his shoulder during a swing; an audible sound device connected to the sensing mechanism to alert the batter when his head is not correctly positioned in relation to his shoulders during the swing; and an electrical power supply integrated with the sensing mechanism and said audible device and wherein said electrical power supply has sufficient voltage to activate the audible device.

7 Claims, 4 Drawing Sheets

BASEBALL BATTING AID

FIELD OF THE INVENTION

The present invention relates to a batting aid for baseball players. More particularly, the present invention relates to a device which aids in the training and teaching of hitting techniques in baseball.

BACKGROUND OF THE INVENTION

Numerous techniques have been developed to improve the ability of a player to hit a ball with a bat, club, racket or other implement. Generally, these techniques rely upon a repetitive practice routine of swinging at the ball. In the case of baseball players, batting tees, batting practice machine and pitchers have been used to improve a batter's swing and hitting ability. While these techniques have been useful, the degree of success with all players has not been particularly great. Further, relatively long periods of time are required with proper instructions to perfect one's ability through constant practice.

Numerous articles have also been published on methods for improving hitting. For example, *THE ART OF HITTING* by Charley Lau with Alfred Glossbrenner (1980) discloses the movement of the head during hitting. *THE SWING'S THE THING* by Ben Hines and Bob McBee (1985) teaches chin and shoulder movement, the fulcrum position, bringing the barrel of the bat in a downward plane into the baseball, and the turning of the head.

It has been well established in the art that proper head to shoulder transfer and movement through the swing is critical in achieving solid contact with the ball in transferring maximum force so as to hit the ball as far as possible. U.S. Pat. No. 4,605,226 by Morrissey discloses a training device to be used in the sport of baseball and the like which enables the user to improve his hand-eye coordination and to maximize the head to shoulder transfer. The device of Morrissey is mounted on a protective helmet, said device comprising a shield having a top flange and a main opaque body releasably mounted on a protective helmet on the side opposite the source of the projectile travelling towards the user. In the case of baseball, the user's head being out of the desired position will result in a shielding of the eyes of the user from the projectile.

U.S. Pat. No. 4,300,765 by Stringham discloses a batting aid which is comprised of a shoulder piece for positioning on the shoulder of the batter, a jaw piece for positioning against the jaw of the batter and the means which connects the shoulder piece and jaw piece together in a spaced relation to each in order to impede movement of the jaw of the batter towards the shoulder during a swing.

U.S. Pat. No. 4,502,035 by Obenauf et al. teaches means by which a golfer is provided direct real-time feedback on the occurrence and severity of his head movement as the golfer swings at a golf ball. This is accomplished by affixing to the golfer's head, a piezoceramic bender element which senses vertical and horizontal motion in a vertical plane running through the golfer's body, head, shoulder and arms. The movement of the golfer's head is sensed by a motion sensor which generates an electrical signal wherein the magnitude of the signal is relative to the magnitude of the acceleration of the golfer's head. This electrical signal is conveyed by wires to a signal processor which converts the electrical signal received to a second electrical signal which has an amplitude which is a function of the magnitude of the acceleration sensed. This signal is then directed to an audio output which alerts the user of his body position.

Since the motion sensor of Obenauf et al. senses both vertical and horizontal movement and the alarming device or noise frequency does not differentiate the vertical and horizontal movement, then it becomes very difficult for the user to differentiate for example in the case of a higher frequency whether or not the deficiency is as a result of the user's faster or higher head movement acceleration. Also, the continuous audio output device often times affects the user concentration and detracts from his efficient performance. Lastly, Obenauf et al. does not address the adaptability of this device to the different body forms of the users. Because of the variety of body shape, form and style of hitting utilized by baseball players, the acceptability of any device is dependent upon the ability of that device to adapt to the different body shape, form and hitting style. Odenauf et al has no such adaptability and will ultimately result in difficulty for a wide variety of users.

Further, U.S. Pat. No. 4,826,165 by Roger Socci disclosed a device which teaches a method for hitting a baseball. In Socci the batter is fitted with a cumbersome shoulder harness with a chin holder connected thereto in a manner to allow for movement of the chin holder on a plane from the right shoulder to the left shoulder in an elliptical fashion. Though Socci teaches a workable training module, the device itself, however, is impractical and cumbersome.

The present invention does away with this cumbersome device by obviating the use of the shoulder harness and chin holder mechanism and incorporates an non-disruptive device within the helmet of the baseball batter which senses the head movement of the batter in relationship to the batter's shoulder as the batters swings at a baseball. By sensing the movement of the batter's head during the swing, the batter is in a position to correct his head and shoulder movement and thereby improves his swing at the baseball.

It is therefore, an object of the present invention to provide a very simple device to teach baseball players the correct method for hitting a baseball.

Another object of the present invention is to provide a batting aid for a baseball player which will enable the batter to keep his head and front shoulder in the correct position when hitting a baseball.

A further object of the present invention is to provide a simple hitting device which can improve the hitting stance of a batter.

Still a further object of the present invention is to provide a device which sense movement of a baseball batter's head during the swing and conveys same to the batters when his head is not in the proper position in relation to his shoulder during the swing.

These and other object of the present invention will become more apparent as you proceed through the detailed description.

SUMMARY OF THE INVENTION

The present invention is concerned with a training device which can be worn by a user to teach the correct body position when hitting a baseball comprising: an adjustable sensing mechanism fitted on the batters helmet to sense the vertical movement of the batters's head in relation to his shoulder during a swing; an audible sound device connected to the sensing mechanism to alert the batter when his head is not correctly positioned in relation to his shoulders during the swing; and an electrical power supply integrated with the sensing mechanism and said audible device and wherein said electrical power supply has sufficient voltage to activate the audible device.

BRIEF DESCRIPTION OF THE INVENTION

DETAILED DESCRIPTION OF THE INVENTION

The present invention discloses a teaching and training tool for demonstrating a baseball player's proper head movement during the process of hitting a pitched baseball.

Figure 1:
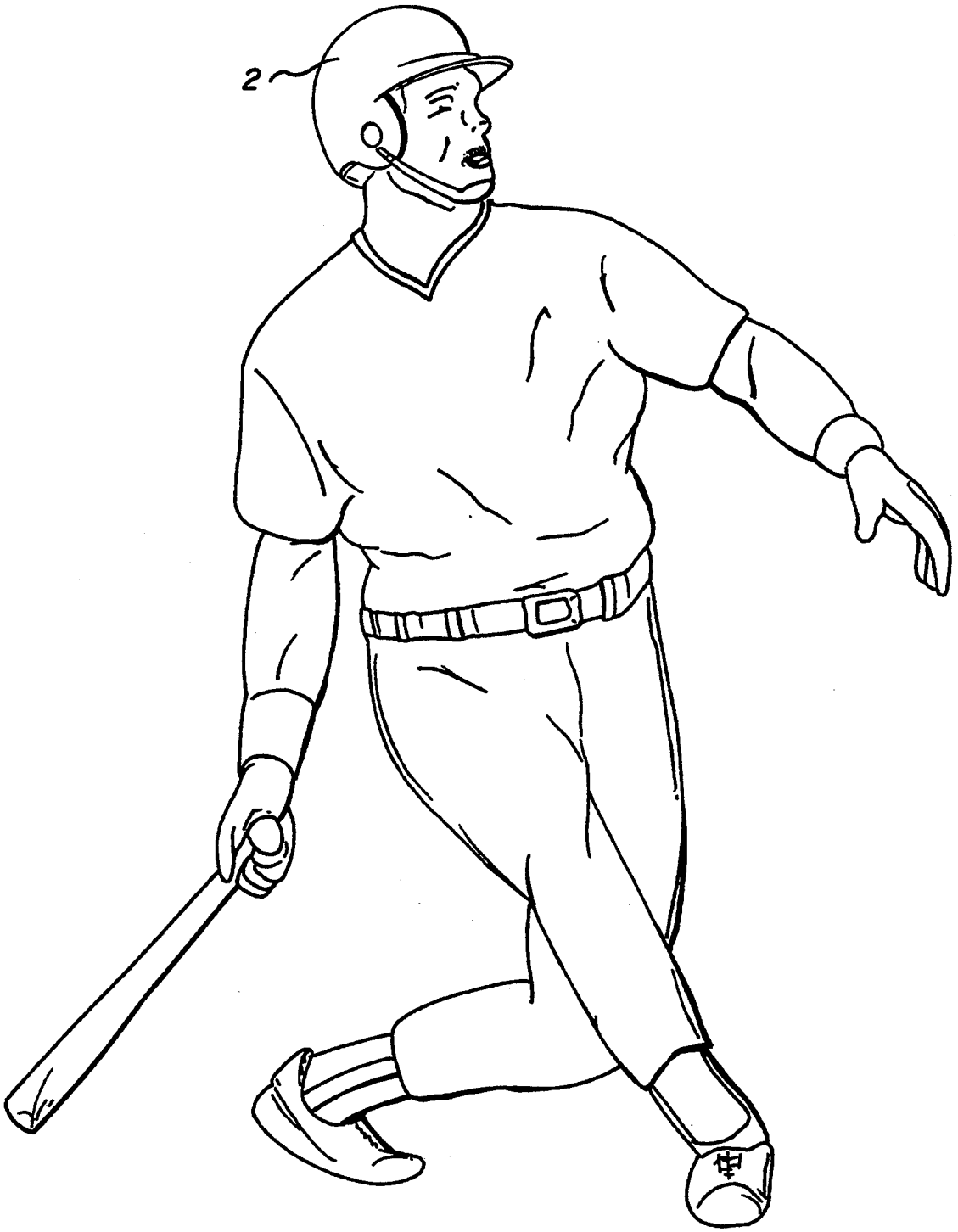
FIG. 1 is a perspective view of the batter fitted with a helmet containing the entire sensing mechanism of the present invention.

FIG. 1 is an illustration of a baseball player as he completes his swing at a baseball while wearing a baseball helmet containing the device of the present invention. The device of the present invention is housed within the helmet 2 and is incorporated as an integral part of the helmet which makes it generally not visible unless the helmet is removed and examined. Typically, the batter would wear this helmet in the same manner he would wear an helmet not equipped with the device of the present invention. Also, this device is incorporated into the helmet in a manner to assure non-interferance with the batter's comfort and use of the helmet.

Figure 2:
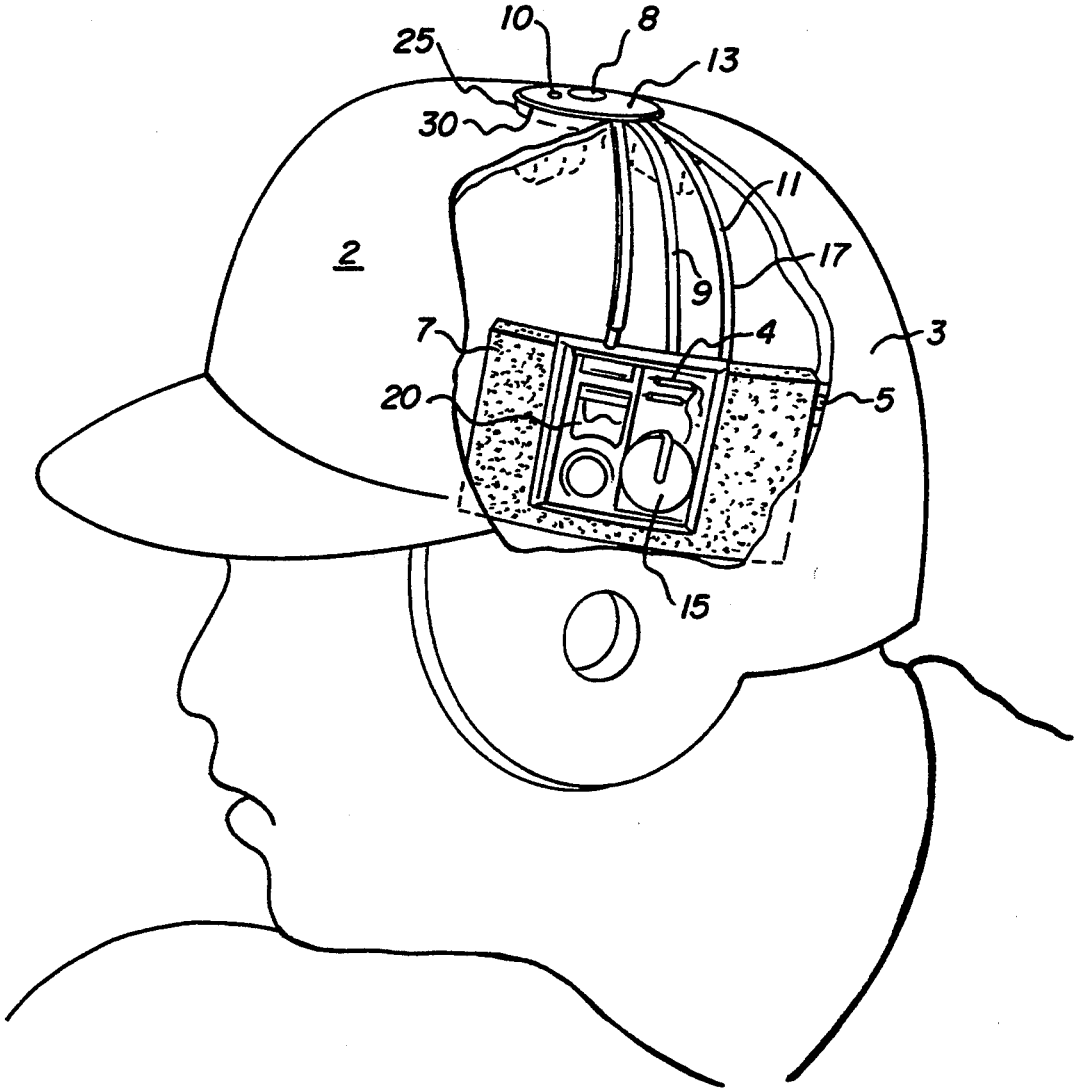
FIG. 2 is a side view showing the construction orientation of the helmet, showing the complete sensing device fitted therein.

Referring now to FIG. 2, a side view showing the construction orientation of the helmet with the complete sensing device fitted therein. The sensing device 4 is intricately fitted within the side wall of the helmet between the outer shell 3 which is coated with an adhesive foam material 5 and the inner adhesive foam material 7. The location of this device within the walls of the helmet prevents its interference with the batter's use of the helmet. Also located within the helmet is an on/off activation switch 8 which is connected to the sensing device by means of electrical connecting wire 9. This switch is typically located at the top center of the helmet which provides easy access to the user. Additionally, located within the helmet is a signal sensitivity adjustment switch 10 which can be manipulated to adjust the sensitivity of the device to accommodate the variation in the physical structure of the user. This switch is connected to the sensing device by means of a mechanical connection 11, because this adjustment can only be accomplished by physically adjusting the position of a motion sensor 20 located within sensing mechanism 4. The location of the signal sensitivity adjustment switch within the helmet is generally not critical. However, the switch should be located in a manner so that it does not interfere with the use of the helmet. A suitable location of this switch is the top center of the helmet next to the on/off switch.

Also located within the helmet is alarm sensitivity adjustment switch 13 which is connected to alarm/buzzer 15 by means of wire connector 17 which controls the level of the audible signal that is transmitted to the batter. This switch can be located anywhere on the helmet provided that it does not interfere with the batter's use of the helmet.

Located within the sensing device is motion sensor 20 which typically senses vertical motion, i.e. movement of the batter's head on a vertical plane in relation to the batters shoulder. This is accomplished by a mercury switch which can be turned on and off based upon the setting or the adjustment of the position of the signal sensitivity adjustment switch 10. The motion sensor of the present invention, however, is not intended to be limited to a mercury switch. Any other suitable switch which can detect vertical motion may be utilized. Also, located within the helmet is electrical power supply 25 which should be of sufficient voltage to provide suitable amounts of electrical energy to power the sensing mechanism. Typically, a 3 Volt battery is utilized as a primary power source. The type of battery is generally not critical. However, longer life batteries such as lithium batteries are preferred. Other power sources may be utilized, provided that such power sources are compatible with that which is utilized in the present invention. The location of the electrical power supply is generally not critical. However, care should taken to locate the power supply in an accessible location within the helmet. Suitably, the power supply may be located at the top center 25 of the helmet which allows for easy accessibility through a top pad plug 30. The power supply is connected to the sensing mechanism by electrical wire connection 17.

Figure 3:
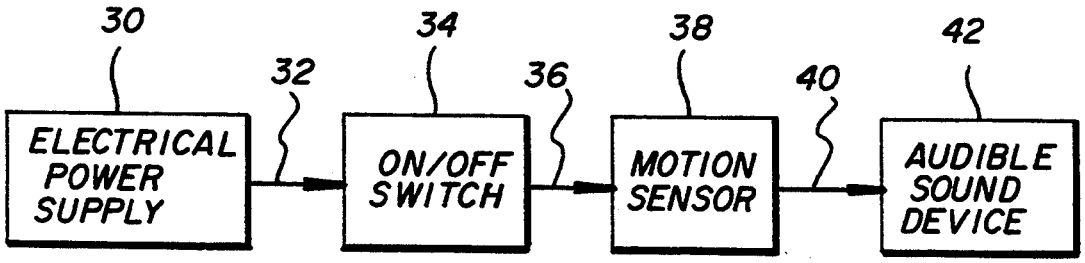
FIG. 3 is a view of the schematic block diagram of the subject invention.

FIG. 3 is a schematic block diagram of the invention as shown. Proceeding in the direction that the signal travels, at the far left is block 30 which represents the electrical power supply. Once the system is turned on, the electrical energy becomes available to power the sensing mechanism. The electrical energy passes along the electrical wire connection 32 to the on/off switch block 34. The on/off switch controls the flow of electrical energy to the motion sensor block 38 through electrical wire connection 36. Once the system is activated, i.e., electrical energy is fed to the system, the motion sensor/mercury switch closes, whereupon a signal is transmitted to the audible sound device block 42 through a wire connector 40 thereby notifying the user that his head and shoulder are in the wrong orientation. If the user head and shoulder movement are in the correct orientation, the system is totally inaudible. It is not until the head and shoulder movement is out of orientation that the mercury switch closes which causes the circuit to complete and the audible sound device to go off which provides notification to the user. There is no continuous audible sound transmitted to the user unless or until he has adopted the wrong stance during the swing.

A critical feature of the present invention is the orientation of the motion sensor. In the instant invention, the preferred motion sensor is an adjustable mercury switch which simply means that the angle of the mercury switch can be adjusted to decrease or increase its sensitivity. Typically, the mercury switch is completely vertical on a level plane and parallel to the shoulders of the user. Therefore, during use, if the batter picks up his head, he would lose track of the ball consequently causing the mercury switch to close and the audible device to sound. Also, if the batter incorrectly dips his head to track the ball, the mercury switch would also close and the sounding device becomes audible. A unique feature of the present invention in the ability to adjust the motion sensor/mercury switch so that the orientation of the batter's head and shoulder does not have to be totally vertical. In this instance the audible sound device is not triggered. For instance, the motion sensor can be adjusted from a totally vertical plane to a totally horizental plane in relation to the batter's shoulder. This allows for an adjustment range of the motion sensor from being totally parallel with the shoulder of the batter to an angle of about 90 degrees with the shoulder of the batter. This feature is very essential in accommodating the different physical features and styles of a baseball batters. Also, this feature can also assist in attacking different types of pitched balls.

Figure 4:
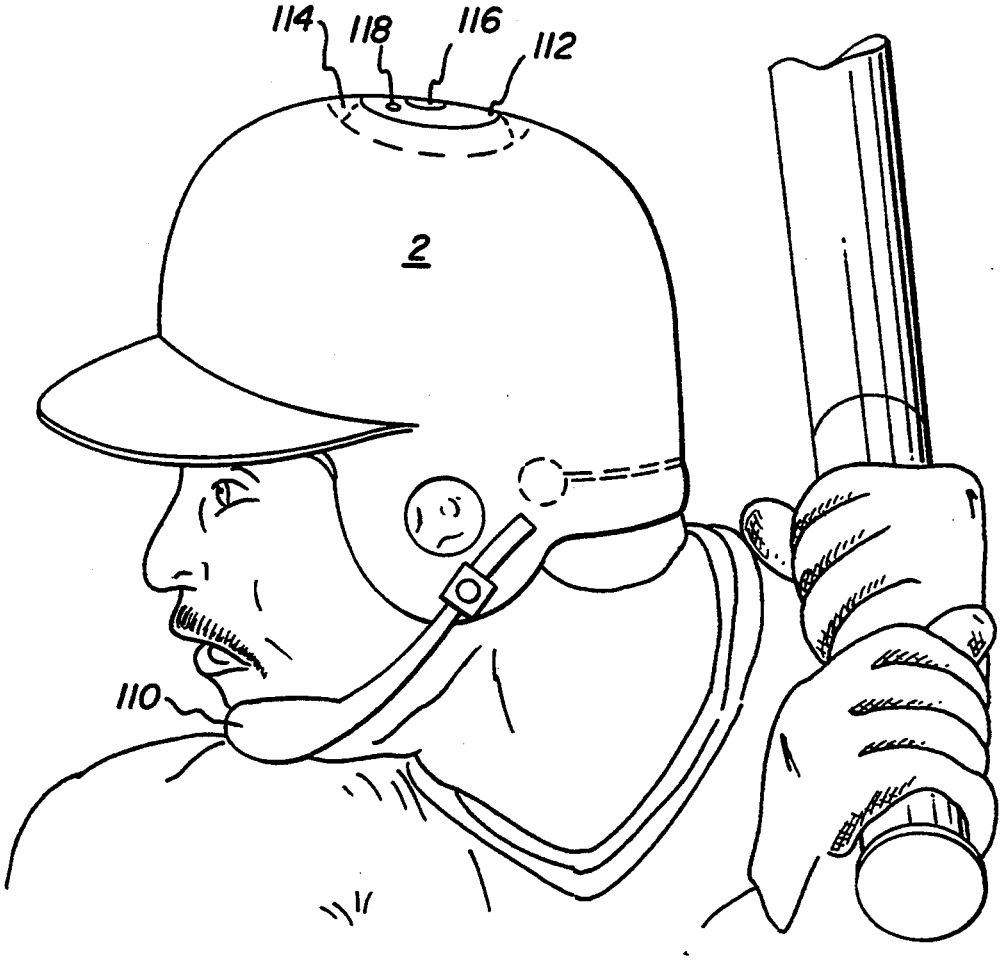
FIG. 4 is a perspective view illustration of the baseball batter utilizing the invention while he takes a swing at the baseball.

FIG. 4 illustrates a perspective view of the preferred embodiment of the present invention which shows a batter's head fitted with the helmet of the present invention in a hitting stance. The helmet fits the same as a typical baseball batter's helmet. The helmet is secured to the head of the batter by the chin strap 110. At the center top of the helmet is located pad plug 112 which is easily removable to allow access to the electrical power supply 114. Also located about the pad plug is on/off switch 116, the signal sensitivity adjustment switch 118, and the alarm sensitivity adjustment switch 120. Within the side wall of the helmet and not visible is the sensing mechanism.

Any suitable audible devices may be utilized in the present invention. This audible device may be in the form of a speaker, buzzer or air phone, said air phone adaptable to be flexibly fitted within the ear of the batter or any other suitable audible device. The limiting feature of this audio mechanism, however, is its compatibility with the electrical circuitry of the sensing mechanism.

Also located within the helmet is a timeout circuit. This time out circuit functions to shut the entire system down if no motion is detected within one minute. Consequently, the electrical energy needed to operate the sensing mechanism is conserved, hence the preservation of the electrical power supply.

Figure 5:
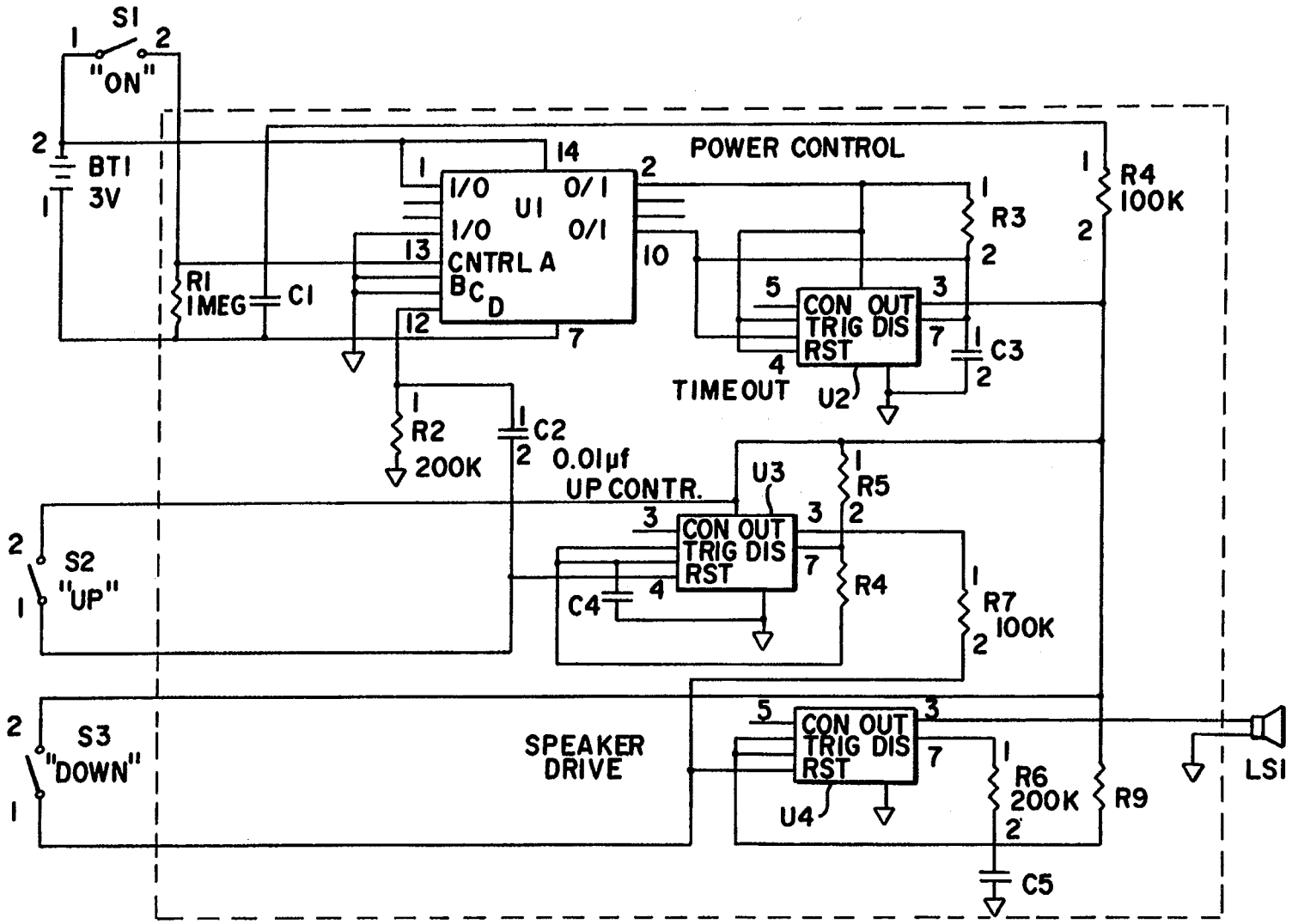
FIG. 5 is a view of the electrical schematic diagram of the subject invention.

FIG. 5 illustrates an electrical schematic of the preferred embodiment of the present invention. This circuit shows conventional electrical designs made up of operational methods which are known to those of ordinary skill in the art.

Essentially, a batter is fitted with the helmet of the present invention and the signal sensitivity and alarm sensitivity are adjusted to their desired position. The mechanism is then activated by turning the on/off switch to the on position. During this period the circuit remains open denying the audio mechanism of a signal. It is not until the circuit is closed, i.e., the mercury switch closed, that the circuitry is activated and a signal is transmitted to the audio mechanism. This only occurs when the batter's head and shoulder orientation is out of place during the batter's swing at the baseball.

In addition to training the correct head movement during the process of hitting the pitched ball, the present invention further inadvertently teaches and trains the proper use of a batter's front shoulder in the hitting process.

What is claimed is:

1. A training device which can be worn by a user to teach the correct body positioning when hitting a baseball comprising:

a) a baseball helmet having a top center and a sidewall and fitted within said sidewall with an adjustable sensing mechanism to sense vertical movement of the batter's head in relation to his shoulders during a swing, the adjustable sensing mechanism comprising a motion sensor, the training device further including a signal sensitivity adjustment switch mounted on the top center of the helmet and connected to the adjustable sensing mechanism by a mechanical connection for physically adjusting the position of the motion sensor in the adjustable sensing mechanism to sense a varying degree of sensitivity on a plane from vertical to horizontal;

b) an audible sounding device connected to the sensing mechanism to alert the batter when his head is not correctly positioned in relation to his shoulders during the swing; and c) an electrical power supply integrated with the sensing mechanism and the audible sound device and wherein said electrical power supply has sufficient voltage to activate the audible sound device.

2. A device according to claim 1 wherein the motion sensor is a mercury switch.

3. A device according to claim 1 wherein the motion sensor can be adjusted from 180 degree vertical to 90 degree in relation to the batter shoulder.

4. A device according to claim 1 further comprising a time out circuit.

5. A device according to claim 1 wherein the audible sound device is a member selected from a group consisting of an alarm, a speaker, a buzzer, and an air phone.

6. A device according to claim 5 wherein the audible sound device is an alarm.

7. A device according to claim 1 further including an alarm sensitivity adjustment switch connected to the audible sound device for controlling levels of an audible signal transmitted by the audible sound device.

* * * * *